US008500118B2

(12) United States Patent
Shimmachi et al.

(10) Patent No.: US 8,500,118 B2
(45) Date of Patent: Aug. 6, 2013

(54) SHEET FEEDING APPARATUS AND IMAGE FORMING APPARATUS

(75) Inventors: Masaya Shimmachi, Kawasaki (JP); Kenji Kawazoe, Yokohama (JP); Kazuyuki Morinaga, Machida (JP); Tetsu Hamano, Tokyo (JP); Toshiaki Tokisawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 12/949,071

(22) Filed: Nov. 18, 2010

(65) Prior Publication Data

US 2011/0133397 A1 Jun. 9, 2011

(30) Foreign Application Priority Data

Dec. 7, 2009 (JP) ..... 2009-277600

(51) Int. Cl.
*B65H 1/26* (2006.01)

(52) U.S. Cl.
USPC ..... 271/157; 271/152; 271/160; 271/265.01

(58) Field of Classification Search
USPC ..... 271/127, 155, 157, 160, 152, 265.01
See application file for complete search history.

(56) References Cited

U.S. PATENT DOCUMENTS

| | | | | |
|---|---|---|---|---|
| 5,240,241 | A | 8/1993 | Kawazoe | |
| 5,398,108 | A * | 3/1995 | Morinaga et al. | 399/381 |
| 5,443,252 | A | 8/1995 | Morinaga et al. | |
| 5,571,265 | A | 11/1996 | Yagi et al. | |
| 5,632,477 | A | 5/1997 | Morinaga | |
| 5,722,654 | A | 3/1998 | Sootome et al. | |
| 5,816,723 | A | 10/1998 | Takahashi et al. | |
| 5,886,729 | A | 3/1999 | Hiramatsu et al. | |
| 6,113,093 | A | 9/2000 | Morinaga et al. | |
| 7,364,152 | B2 | 4/2008 | Suwa | |
| 7,686,302 | B2 * | 3/2010 | Tanahashi et al. | 271/265.01 |
| 8,251,364 | B2 * | 8/2012 | Morinaga et al. | 271/157 |
| 2006/0157914 | A1 | 7/2006 | Suwa | |
| 2009/0302520 | A1 | 12/2009 | Shimmachi et al. | |
| 2010/0102505 | A1 * | 4/2010 | Ikeuchi et al. | 271/262 |
| 2011/0211031 | A1 * | 9/2011 | Satoh et al. | 347/104 |

FOREIGN PATENT DOCUMENTS

| | | |
|---|---|---|
| JP | 08-259039 | 10/1996 |
| JP | 2006-137564 | 6/2006 |

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

A sheet feeding apparatus including sheet feeding unit; a pressure plate on which sheets are stacked and which is biased so that an uppermost sheet of the stacked sheets comes in pressure contact with the sheet feeding unit; a first pressing-down mechanism which presses down the pressure plate to separate the uppermost sheet and the sheet feeding unit by a constant distance when the sheet feeding unit is not operated; a second pressing-down mechanism which is adopted to press down the pressure plate when an amount of the sheets stacked on the pressure plate is smaller than a predetermined amount, and is given a load from the pressure plate depending on a position of the pressure plate; and sheet stacking amount detecting unit which measures the load and detects a stacking amount of the sheets stacked on the pressure plate on the basis of the measured load.

23 Claims, 18 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus having the same.

2. Description of the Related Art

An image forming apparatus for forming an image on a sheet such as a printer, a copying machine, or a fax machine includes a sheet feeding apparatus for feeding a sheet to an image forming unit. Such a sheet feeding apparatus includes an apparatus having a unit with a function of sensing a stacking amount of sheets stacked in the device.

In Japanese Patent Application Laid-Open No. H08-259039, an image forming apparatus is disclosed which includes a cassette for stacking sheets, a sheet feed roller for feeding the sheets stacked in the cassette, driving means for driving the sheet feed roller, and sensing means for sensing that a sheet fed by the sheet feed roller reaches a predetermined point on a conveyance path. In a case where sheet feeding is not performed, a distance between the sheet feed roller and the uppermost sheet in the cassette is changed depending on the stacking amount of sheets in the cassette. Therefore, a time taken to sense the front end of the sheet by the sensing means after a sheet feed signal is output is changed depending on the stacking amount of the sheets. In addition, the image forming apparatus detects the stacking amount (remaining amount) of the sheets by measuring the time taken to sense the sheets by the sensing means after the driving means drives the sheet feed roller.

In Japanese Patent Application Laid-Open No. 2006-137564, a sheet feeding apparatus is disclosed which elevates a pressure plate to lower the position of an uppermost surface of sheets from feeding means by a constant amount at substantially the same timing regardless of a stacking height of the sheets stacked on the pressure plate. The sheet feeding apparatus is able to maintain a constant distance between the uppermost surface of the sheets and the feeding means regardless of a stacking amount of the sheets when the feeding means is not operated. In addition, when a sheet feeding operation is started, the pressure plate is operated so as to allow the uppermost surface of the sheets stacked in the pressure plate to come in pressure contact with the feeding means. Since an operation distance of the pressure plate is constant during the sheet feeding operation, a sheet conveyance timing can become uniform regardless of the stacking amount of the sheets. Accordingly, stability of sheet feeding is enhanced.

However, the mechanism for detecting the remaining amount of sheets disclosed in Japanese Patent Application Laid-Open No. H08-259039 may not be applied to the sheet feeding apparatus disclosed in Japanese Patent Application Laid-Open No. 2006-137564. This is because although the stacking amount of the sheets is detected on the basis of the time taken to sense the sheets by the sensing means after the sheet feed roller is driven in Japanese Patent Application Laid-Open No. H08-259039, the sheet feeding apparatus disclosed in Japanese Patent Application Laid-Open No. 2006-137564 is configured to uniformize the time.

In addition, if hardware such as a dedicated switch or sensor is additionally provided to detect the stacking amount of the sheets, there is a problem in that mechanical or electrical costs are increased.

SUMMARY OF THE INVENTION

An object of the invention is to provide a sheet feeding apparatus capable of maintaining a constant distance between an uppermost surface of sheets and sheet feeding means when means for feeding the sheets is not operated and detecting a stacking amount of the sheets. Another object of the invention is to provide a sheet feeding apparatus capable of detecting a stacking amount of sheets without hardware such as a dedicated switch or a sensor being added.

In order to accomplish the objects, according to an aspect of the invention, a sheet feeding apparatus includes: sheet feeding means which comes in pressure contact with a sheet to feed the sheet; a pressure plate on which sheets are stacked and which is biased so that an uppermost sheet of the stacked sheets comes in pressure contact with the sheet feeding means; a first pressing-down mechanism which presses down the pressure plate to separate the uppermost sheet and the sheet feeding means by a constant distance when the sheet feeding means is not operated; a second pressing-down mechanism which is adopted to press down the pressure plate when an amount of the sheets stacked on the pressure plate is smaller than a predetermined amount, and is given a load from the pressure plate depending on a position of the pressure plate; and sheet stacking amount detecting means which measures the load and detects a stacking amount of the sheets stacked on the pressure plate on the basis of the measured load.

According to another aspect of the invention, an image forming apparatus includes the sheet feeding apparatus and an image forming unit which forms an image on a sheet fed by the sheet feeding apparatus.

According to the aspects of the invention, a constant distance is maintained between an uppermost surface of the sheets and the sheet feeding means when the means for feeding the sheets is not operated and a stacking amount of the sheets stacked on the pressure plate can be detected.

Further features of the present invention will become apparent from the following description of exemplary embodiments with reference to the attached drawings.

DESCRIPTION OF THE EMBODIMENTS

Exemplary embodiments of the invention will now be described with reference to the accompanying drawings.

In the following description, a printer is exemplified as an image forming apparatus. However, the image forming apparatus according to the exemplary embodiments of the invention may be applied to any apparatus having a sheet feeding apparatus for feeding a sheet, for example, a copying machine or a fax machine. In addition, a sheet feeding apparatus according to the exemplary embodiments of the invention is not limited to the sheet feeding apparatus included in the image forming apparatus and may be used as a single device for feeding stacked sheets.

Figure 1:
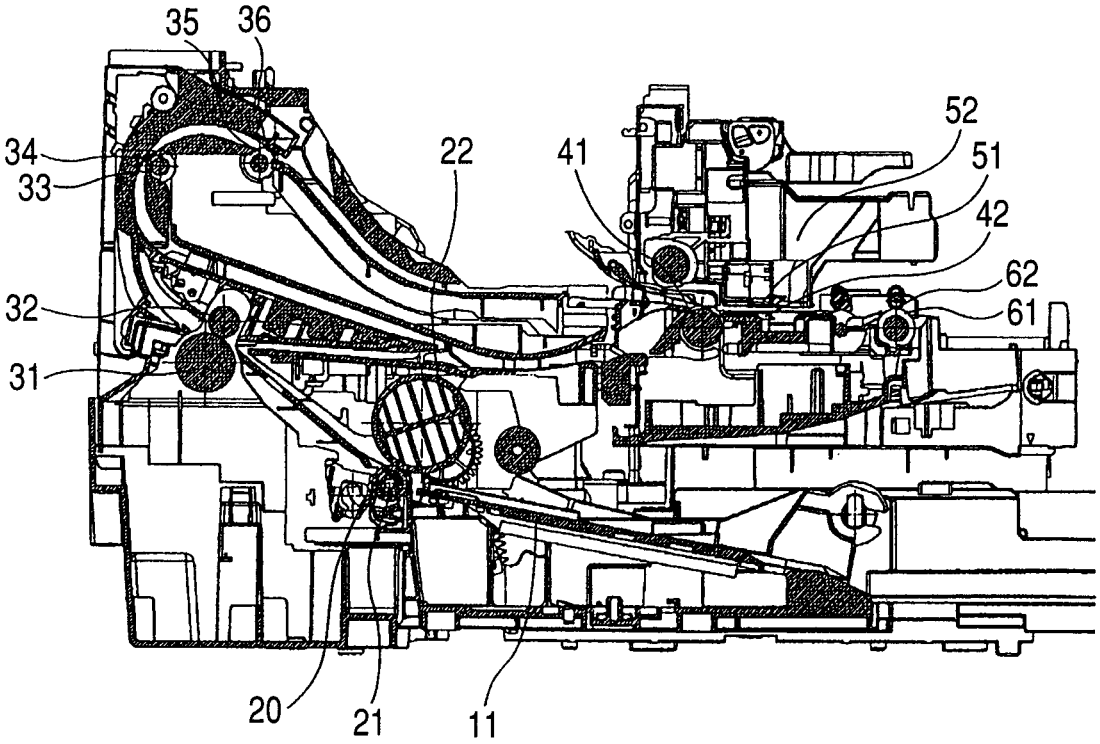
FIG. 1 is a cross-sectional view schematically illustrating an image forming apparatus according to a first embodiment of the invention.
Figure 2:
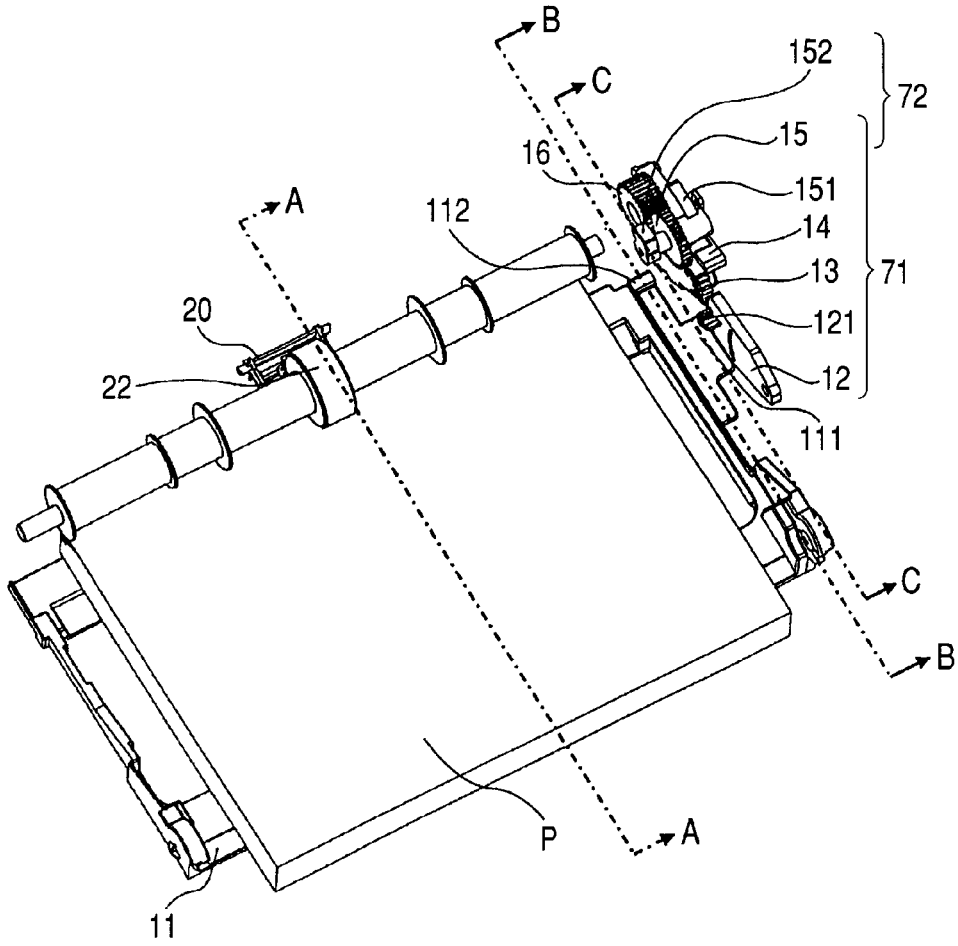
FIG. 2 is a perspective view schematically illustrating a sheet feeding apparatus included in the image forming apparatus of FIG. 1.

FIG. 1 is a cross-sectional view schematically illustrating the configuration of a printer having a sheet feeding apparatus according to an embodiment of the invention. FIG. 2 is a perspective view schematically illustrating the sheet feeding apparatus included in the printer illustrated in FIG. 1. The printer according to this embodiment includes the sheet feeding apparatus and an image forming unit for forming an image on the sheet fed from the sheet feeding apparatus.

The sheet feeding apparatus includes a pressure plate 11 on which sheets can be stacked, and a feeding roller 22 as sheet feeding means for feeding the sheets stacked on the pressure plate 11. The feeding roller 22 comes in contact with the uppermost sheet from among the sheets stacked on the pressure plate 11 to feed the contacted uppermost sheet.

The pressure plate 11 is movable in a stacking direction of the sheets in which the sheets are stacked. Specifically, a pressure plate gear 12 is provided with a pressure plate cam 121 so as to be pivotably mounted to the device, and simultaneously, the pressure plate 11 may be applied with a load so as to stand on its own at a free position. In addition, the pressure plate 11 is biased by biasing means (not shown) in a direction in which the feeding roller 22 is disposed to allow the uppermost sheet from the stacked sheets to come in pressure contact with the feeding roller 22. As the feeding roller 22 is driven while the feeding roller 22 is in contact with the sheet P, the sheet P stacked on the pressure plate 11 is fed (feeding state).

The fed sheets P are sent to a pair of the feeding roller 22 and a separation roller 21 to be separated one by one. The separation roller 21 is supported to be rotatable about a separation arm 20 at a predetermined rotation load to be biased toward the feeding roller 22 by another biasing means (not shown).

The sheets P separated one by one by the feeding roller 22 and the separation roller 21 are fed to the outside of the sheet feeding apparatus. According to this embodiment, the sheet fed from the sheet feeding apparatus is sent to a sheet conveyance path in the printer. Specifically, the sheet is sent to a conveying roller 41 to be conveyed to a platen 42 by pairs of assist rollers 31, 32, 33, 34, 35, and 36 provided on the sheet conveyance path.

On the surface of the sheet P conveyed on the platen 42, an image is formed by a recording head 51 mounted on a carriage 52. The sheet on which the image is formed is discharged outside the printer by a discharge roller 61 and a discharge spur 62.

Figure 3A:
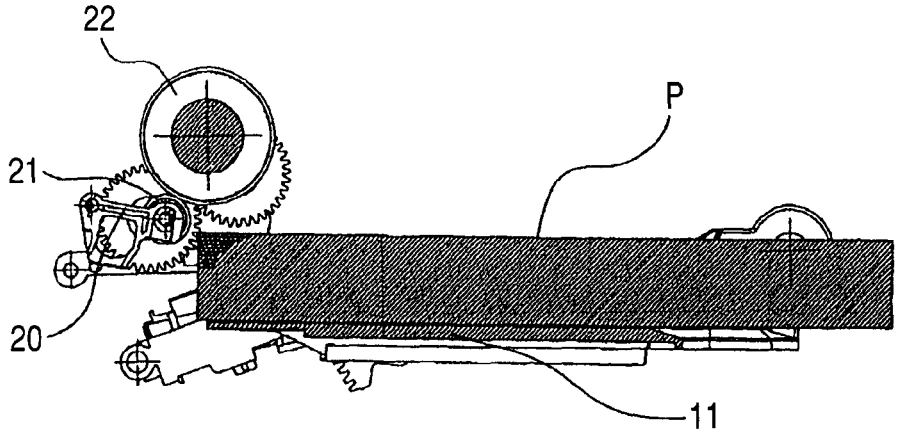
FIG. 3A is a cross-sectional view schematically illustrating the sheet feeding apparatus taken along the line A-A of FIG. 2, in which many sheets are stacked in a non-feeding state.
Figure 3B:
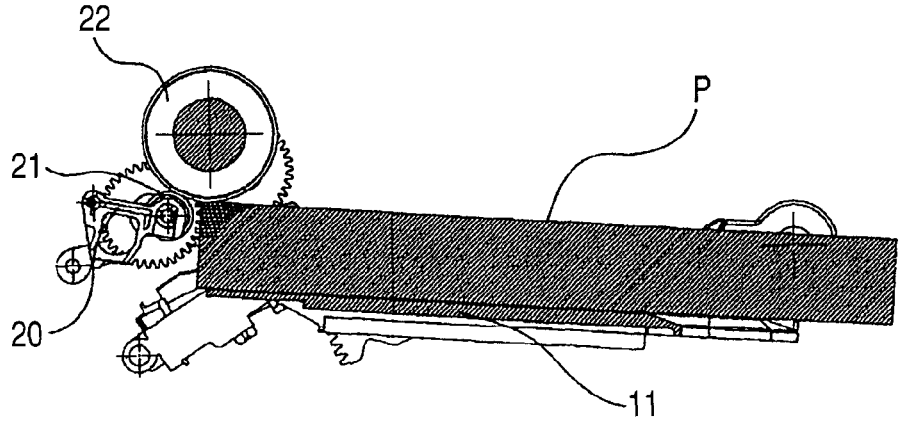
FIG. 3B is a cross-sectional view schematically illustrating the sheet feeding apparatus taken along the line A-A of FIG. 2, in which many sheets are stacked in a feeding state.
Figure 4A:
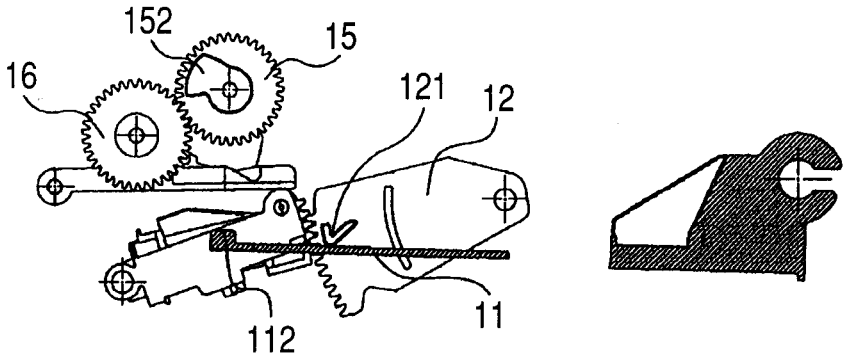
FIG. 4A is a cross-sectional view schematically illustrating the sheet feeding apparatus taken along the line B-B of FIG. 2, in which many sheets are stacked in the non-feeding state.
Figure 4B:
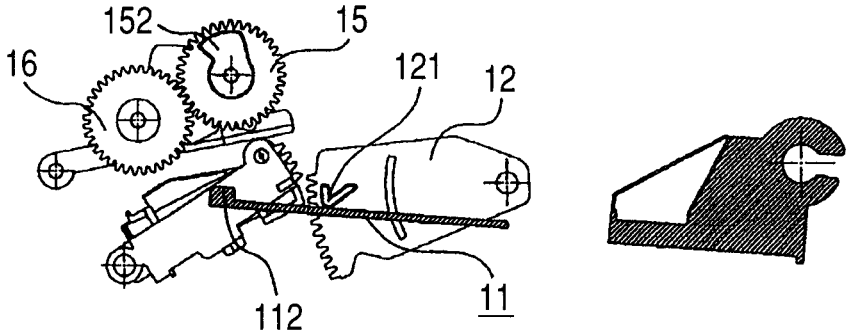
FIG. 4B is a cross-sectional view schematically illustrating the sheet feeding apparatus taken along the line B-B of FIG. 2, in which many sheets are stacked in the feeding state.
Figure 5A:
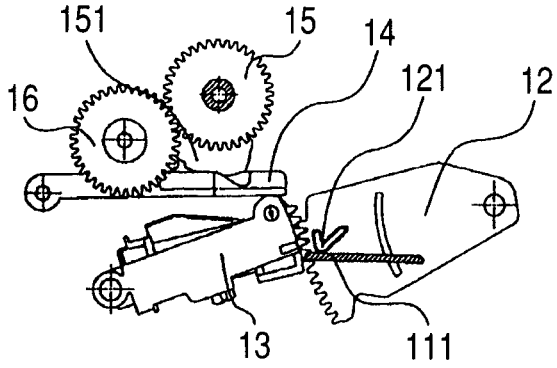
FIG. 5A is a cross-sectional view schematically illustrating the sheet feeding apparatus taken along the line C-C of FIG. 2, in which many sheets are stacked in the non-feeding state.
Figure 5B:
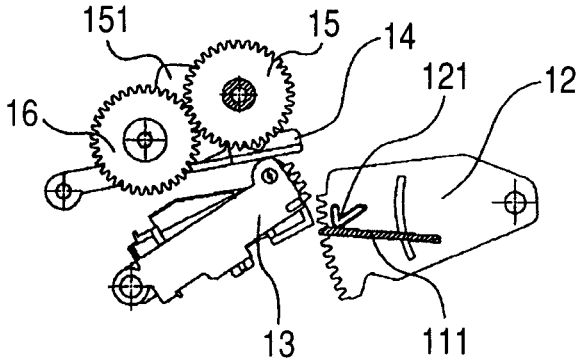
FIG. 5B is a cross-sectional view schematically illustrating the sheet feeding apparatus taken along the line C-C of FIG. 2, in which many sheets are stacked in the feeding state.

Next, operations of the sheet feeding apparatus will be described. FIG. 3A is a cross-sectional view schematically illustrating the sheet feeding apparatus taken along the line A-A of FIG. 2 in a non-feeding state, and FIG. 3B is a cross-sectional view schematically illustrating the sheet feeding apparatus taken along the line A-A of FIG. 2 in a feeding state. Here, the non-feeding state is a state where the feeding roller 22 is not operated and thus the sheets are not fed. In addition, FIG. 4A is a cross-sectional view schematically illustrating the sheet feeding apparatus taken along the line B-B of FIG. 2 in the non-feeding state, and FIG. 4B is a cross-sectional view schematically illustrating the sheet feeding apparatus taken along the line B-B of FIG. 2 in the feeding state. Moreover, FIG. 5A is a cross-sectional view schematically illustrating the sheet feeding apparatus taken along the line C-C of FIG. 2 in the non-feeding state, and FIG. 5B is a cross-sectional view schematically illustrating the sheet feeding apparatus taken along the line C-C of FIG. 2 in the feeding state.

The sheet feeding apparatus includes a first pressing-down mechanism 71 and a second pressing-down mechanism 72 for pressing down the pressure plate 11 in a direction away from the feeding roller 22. The first pressing-down mechanism 71 presses the pressure plate 11 down when the feeding roller 22 is not operated. The second pressing-down mechanism 72 presses down the pressure plate 11 from a time point at which the feeding roller 22 feeds the sheet until the first pressing-down mechanism 71 presses down the pressure plate 11 when an amount of sheets stacked on the pressure plate 11 is smaller than an amount set in advance.

The first pressing-down mechanism 71 includes a control cam gear 15 which is driven by a transmission gear 16 so as to be pivotable, a stopper lever 14, a release cam gear 13 as a transmission member, and the pressure plate gear 12. The transmission gear 16 transmits a driving force from a drive source (motor) which is not shown to the first pressing-down mechanism 71.

A release cam 151 as a first cam portion is formed integrally with the control cam gear 15. The release cam 151 is reciprocated in the stacking direction of the sheets as the control cam gear 15 is rotated so as to press down the stopper lever 14 or be separated from the stopper lever 14. As such, the release cam 151 converts a rotation movement of the motor to a movement in the stacking direction of the sheets stacked on the pressure plate. The release cam gear 13 is biased by biasing means (not shown) in a direction raising the stopper lever 14.

The release cam gear 13 as the transmission member is moved by the stopper lever 14 and transmits the movement of the release cam 151 as the first cam portion to the pressure plate 11 to move the pressure plate 11 by a constant distance. Specifically, the release cam gear 13 is moved while meshing with the pressure plate gear 12 provided at the pressure plate 11. The pressure plate gear 12 comes in pressure contact with the pressure plate 11 to press down the pressure plate 11.

In the non-feeding state where the sheet feeding apparatus does not feed sheets, as illustrated in FIGS. 3A, 4A, and 5A, the release cam 151 presses down the release cam gear 13 via the stopper lever 14. Accordingly, the release cam gear 13 causes the pressure plate gear 12 to pivot, so that the pressure plate cam 121 provided in the pressure plate gear 12 presses down a first pressed portion 111 provided in the pressure plate 11. In this manner, when the feeding roller 22 is not operated, the first pressing-down mechanism 71 presses down the pressure plate 11 by a constant distance to separate the sheets stacked on the pressure plate 11 from the feeding roller 22.

In the feeding state, as illustrated in FIGS. 3B, 4B, and 5B, the control cam gear 15 is rotated by the driving force transmitted from the motor as the drive source by the transmission gear 16. Accordingly, the pressing-down of the stopper lever 14 pressed-down by the release cam 151 formed on the control cam gear 15 is released. In this manner, the pressing-down of the pressure plate gear 12 is released as the release cam gear 13 pivots.

When the pressing-down of the pressure plate gear is released, the pressure plate 11 pivots due to the biasing means (not shown) in such a direction that the sheets stacked on the pressure plate 11 come in pressure contact with the roller, and thus the sheet P comes in pressure contact with the feeding roller 22 as illustrated in FIG. 3B. The sheet is fed by driving the feeding roller 22 in this state. When feeding of the sheet is ended, the first pressing-down mechanism 71 presses down the pressure plate 11 to switch to the non-feeding state from the feeding state again.

Next, in a case where no sheets are stacked on the pressure plate 11 or in a case where few sheets are stacked, operations of the sheet feeding apparatus in the feeding state and in the non-feeding state will be described.

Figure 6A:
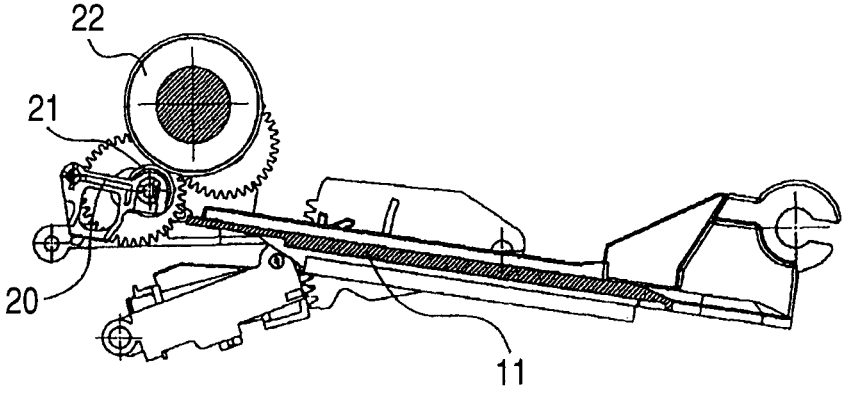
FIG. 6A is a cross-sectional view schematically illustrating the sheet feeding apparatus taken along the line A-A of FIG. 2, in which no sheets are stacked in the non-feeding state.
Figure 6B:
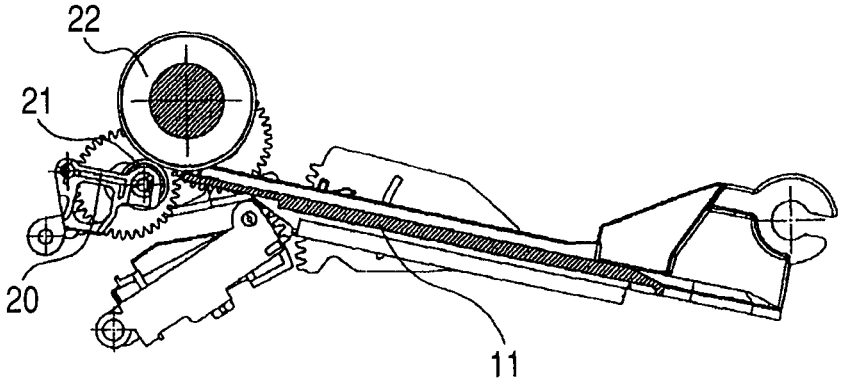
FIG. 6B is a cross-sectional view schematically illustrating the sheet feeding apparatus taken along the line A-A of FIG. 2, in which no sheets are stacked in the feeding state.
Figure 7A:
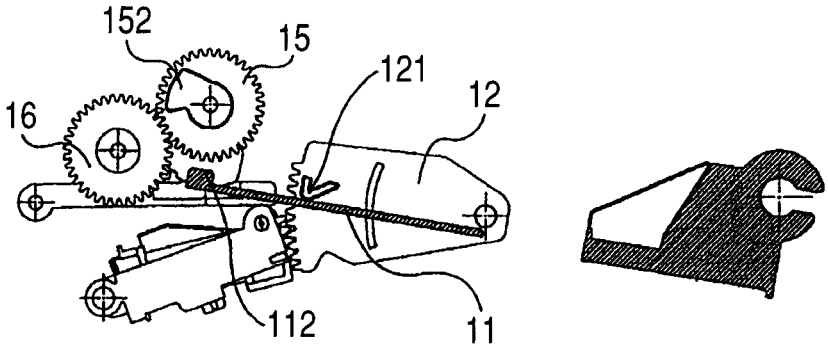
FIG. 7A is a cross-sectional view schematically illustrating the sheet feeding apparatus taken along the line B-B of FIG. 2, in which no sheets are stacked in the non-feeding state.
Figure 7B:
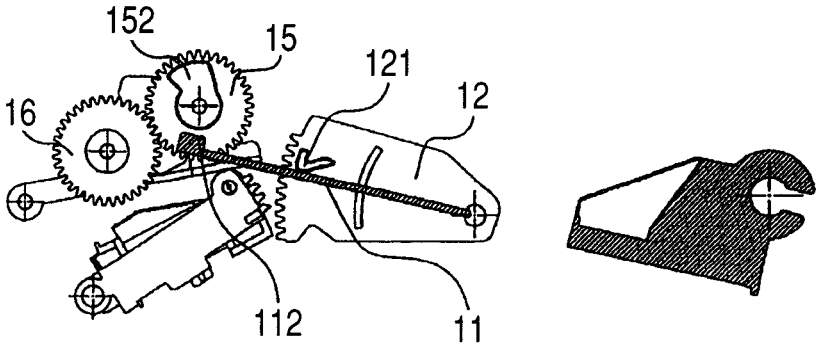
FIG. 7B is a cross-sectional view schematically illustrating the sheet feeding apparatus taken along the line B-B of FIG. 2, in which no sheets are stacked in the feeding state.
Figure 8A:
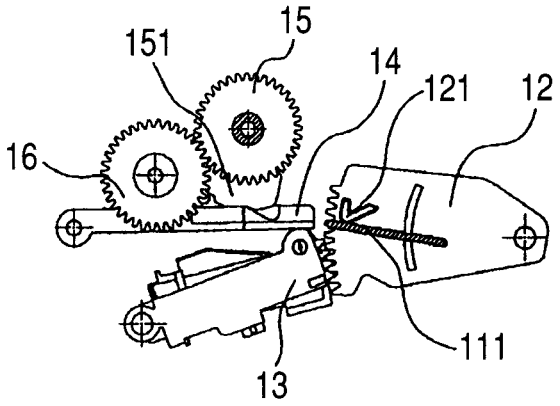
FIG. 8A is a cross-sectional view schematically illustrating the sheet feeding apparatus taken along the line C-C of FIG. 2, in which no sheets are stacked in the non-feeding state.
Figure 8B:
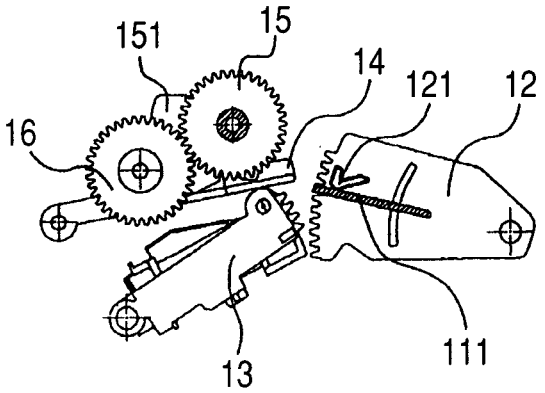
FIG. 8B is a cross-sectional view schematically illustrating the sheet feeding apparatus taken along the line C-C of FIG. 2, in which no sheets are stacked in the feeding state.
Figure 9A:
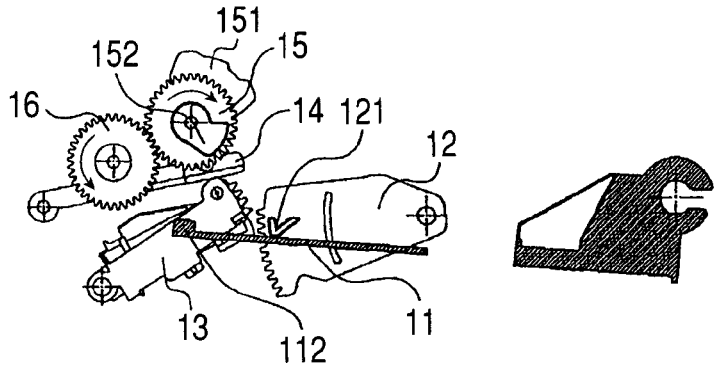
FIGS. 9A, 9B, 9C, and 9D are cross-sectional views schematically illustrating an operation for transiting the sheet feeding apparatus in which many sheets are stacked from the feeding state to the non-feeding state.
Figure 9B:
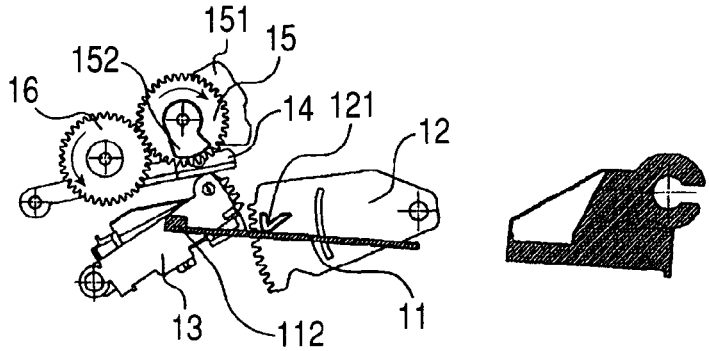
Figure 9C:
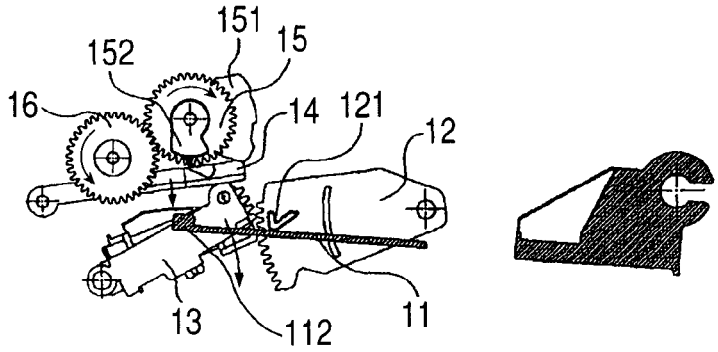
Figure 9D:
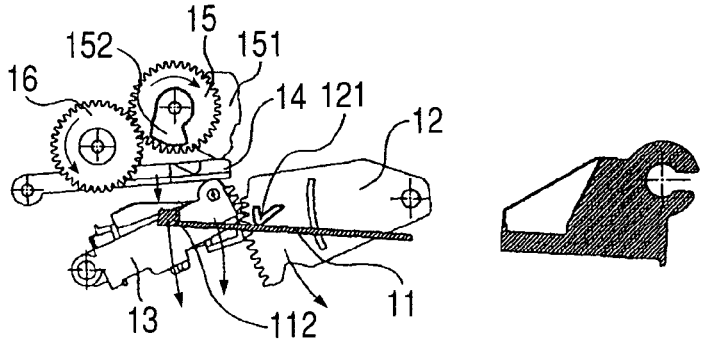

FIGS. 6A and 6B, 7A and 7B, and 8A and 8B are cross-sectional views schematically illustrating the sheet feeding apparatus in the case where no sheets are stacked on the pressure plate 11. Specifically, FIG. 6A is a cross-sectional view schematically illustrating the sheet feeding apparatus taken along the line A-A of FIG. 2 in the non-feeding state, and FIG. 6B is a cross-sectional view schematically illustrating the sheet feeding apparatus taken along the line A-A of FIG. 2 in the feeding state. In addition, FIG. 7A is a cross-sectional view schematically illustrating the sheet feeding apparatus taken along the line B-B of FIG. 2 in the non-feeding state, and FIG. 7B is a cross-sectional view schematically illustrating the sheet feeding apparatus taken along the line B-B of FIG. 2 in the feeding state. Moreover, FIG. 8A is a cross-sectional view schematically illustrating the sheet feeding apparatus taken along the line C-C of FIG. 2 in the non-feeding state, and FIG. 8B is a cross-sectional view schematically illustrating the sheet feeding apparatus taken along the line C-C of FIG. 2 in the feeding state.

In comparison between the case where sheets are stacked and the case where no sheets are stacked, the position of the pressure plate 11 is different, and the position of the pressure plate gear 12 is also different. That is, the pressure plate 11 moves closer to the feeding roller 22 as the amount of sheets stacked on the pressure plate 11 becomes smaller.

Accordingly, the position of the pressure plate gear 12 is changed depending on the amount of sheets stacked on the pressure plate 11. Moreover, immediately after the first pressing-down mechanism 71 is driven, the release cam gear 13 meshes with the pressure plate gear 12, so that a movement amount of the released cam gear 13 moved when the feeding state is transited to the non-feeding state is constant regardless of the stacking amount of sheets. Therefore, the release cam gear 13 presses down the pressure plate 12 by only the constant amount. As such, the first pressing-down mechanism 71 presses down the pressure plate 11 by a constant distance regardless of the stacking amount of sheets. Accordingly, in the non-feeding state, a constant distance is provided between the sheet and the feeding roller 22 regardless of the stacking amount of sheets.

Next, operations of the second pressing-down mechanism 72 performed during a transition from the feeding state to the non-feeding state will be described. FIGS. 9A to 9D illustrate a case where a relatively high number of sheets are stacked on the pressure plate 11, FIGS. 10A to 10D illustrate a case where no sheets are stacked on the pressure plate 11, and FIGS. 11A to 11D illustrate a case where relatively few sheets are stacked on the pressure plate 11.

The second pressing-down mechanism 72 receives the driving force from the motor (not shown) as the drive source. A driving force of the motor may be controlled by a predetermined method. According to this embodiment, for example, as the motor for driving the second pressing-down mechanism 72, a DC motor for driving the pressure plate, of which the driving force is controlled by a pulse width modulation (PWM) method is used. Accordingly, the motor is controlled according to a load torque that may be applied to the motor.

Specifically, a driving system is provided with an encoder to calculate a driving amount or a driving speed of the driving system from the output of the encoder. On the basis of information on the driving amount and the driving speed, a pulse width of a current flowing through the motor is modulated (a duty is changed) to perform feedback control to achieve a target driving amount or driving speed.

Here, as the pulse width is increased (that is, as the duty is increased), the output of the motor is increased, and as the pulse width is reduced (as the duty is reduced), the output of the motor is reduced. That is, in the case where the load torque applied to the driving system during the driving of the motor is increased, the duty of PWM (hereinafter, referred to as a PWM value) is controlled such that it is increased so as to raise the motor output, and in the case where the load torque is reduced, the PWM value is controlled such that it is reduced so as to suppress the motor output.

Figure 12:
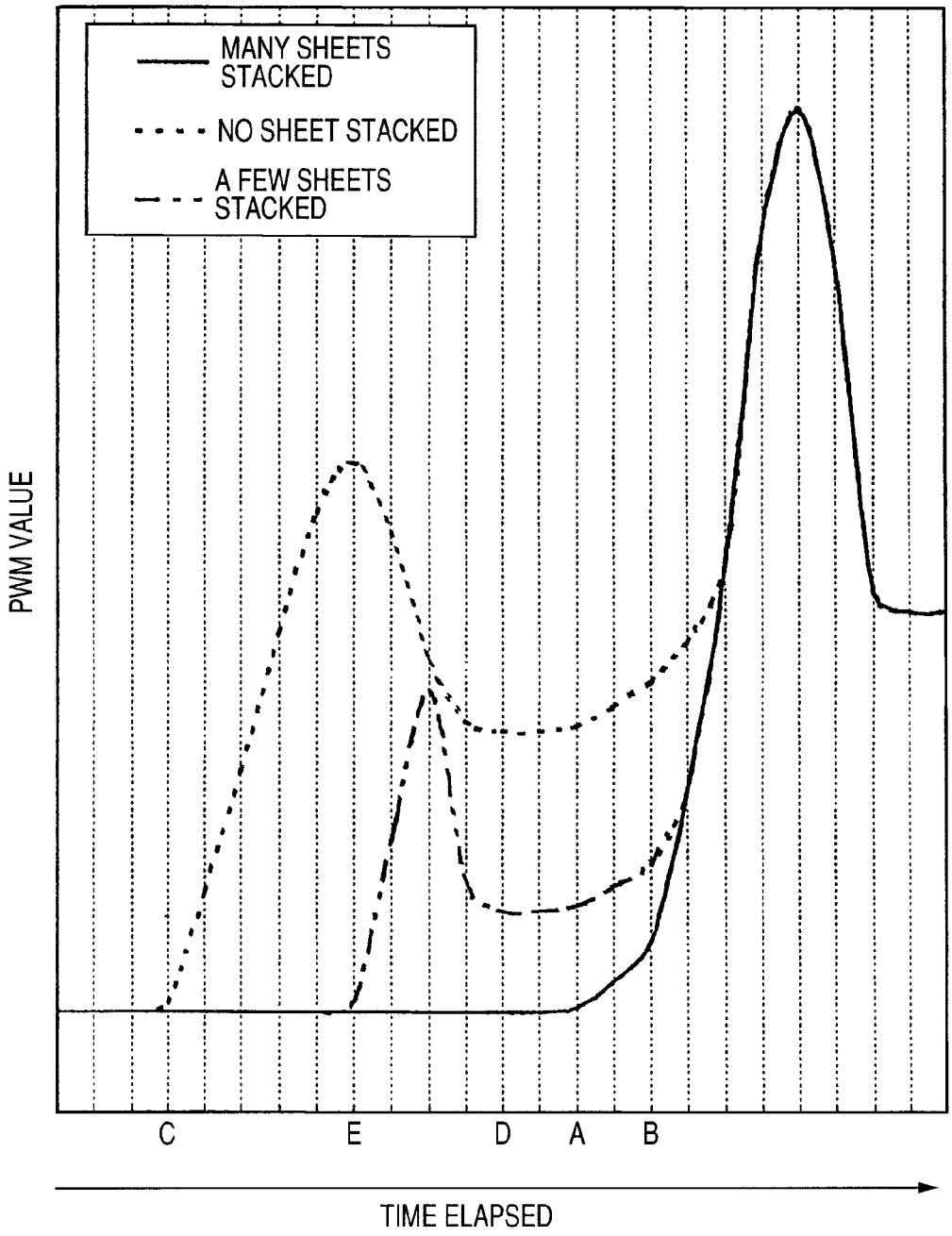
FIG. 12 is a graph showing PWM values of a motor for driving a second pressing-down mechanism when the feeding state is transited to the non-feeding state according to the first embodiment.

FIG. 12 is a graph showing PWM values of the motor depending on the stacking amount of sheets. The horizontal axis in the figure represents a time elapsed when the feeding state is transited to the non-feeding state.

The second pressing-down mechanism 72 also includes the control cam gear 15 which is driven by the transmission gear 16 so as to be pivotable. As such, the control cam gear 15 functions as a part of the first pressing-down mechanism 71 and also as a part of the second pressing-down mechanism 72. In addition, the motor for driving the second pressing-down mechanism 72 also functions as means for driving the first pressing-down mechanism 71, so that the transmission gear 16 transmits the driving force to both the pressing-down mechanisms 71 and 72. As such, by integrating the first and second pressing-down mechanisms 71 and 72 with each other, the sheet feeding apparatus can be provided with a simple and easy configuration.

The control cam gear 15 includes a pressure plate release cam 152 formed integrally as a second cam portion, and the pressure plate 11 is provided with a second pressed portion 112 that the pressure plate release cam 152 is able to come in contact with.

The second pressing-down mechanism 72 is configured to press down the pressure plate 11 when an amount of sheets stacked on the pressure plate 11 is smaller than a predetermined amount, and is given a load depending on the position of the pressure plate 11 from the pressure plate 11 when pressing down the pressure plate 11.

Moreover, the sheet feeding apparatus has sheet stacking amount detecting means for measuring the load and detecting the stacking amount of the sheets stacked on the pressure plate 11 on the basis of the measured load. In this embodiment, as the sheet stacking amount detecting means, measuring means for detecting the PWM value of the motor and measuring timings until the PWM value is equal to or greater than the threshold value set in advance from the start of driving is provided.

According to this embodiment, in the case where the stacking amount of sheets is large, the second pressing-down mechanism 72 does not press down the pressure plate 11. Therefore, during the transition from the feeding state to the non-feeding state, only the first pressing-down mechanism 71 presses down the pressure plate 11. That is, the control cam gear 15 is turned by the driving from the transmission gear 16 such that the release cam 151 starts pressing down the stopper lever 14 from the position illustrated in FIG. 9C. At this timing, the load torque of the motor is increased, and the PWM value starts increasing (timing A in FIG. 12). In addition, at a time point at which the stopper lever 14 is pressed down to a position illustrated in FIG. 9D, the release cam gear 13 meshes with the pressure plate gear 12 to start separation from the pressure plate 11. Accordingly, the PWM value of the motor is further increased (timing B in FIG. 12).

On the other hand, in the case where no sheets are stacked, the second pressing-down mechanism 72 presses down the pressure plate 11 before the first pressing-down mechanism 71 presses down the pressure plate 11. Specifically, first, the pressure plate release cam 152 comes in contact with the second pressed portion 112 provided in the pressure plate 11 (see FIG. 10A). Here, the load torque of the motor starts increasing, and the PWM value also starts increasing (timing C in FIG. 12).

Figure 10A:
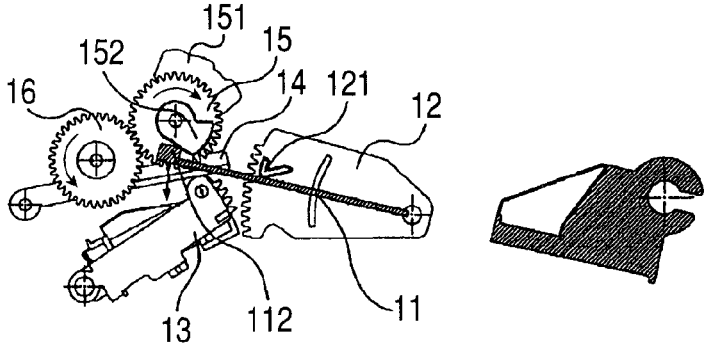
FIGS. 10A, 10B, 10C and 10D are cross-sectional views schematically illustrating an operation for transiting the sheet feeding apparatus in which no sheets are stacked from the feeding state to the non-feeding state.
Figure 10B:
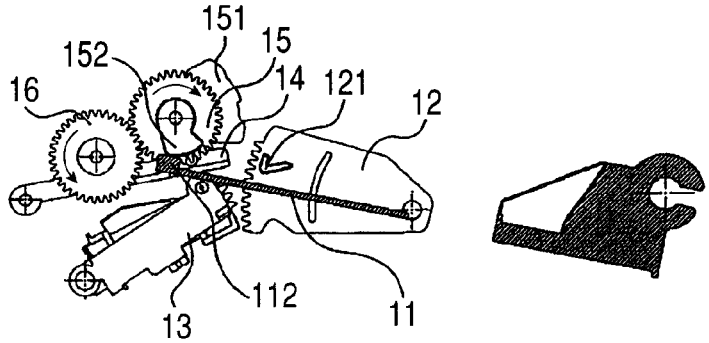

As such, the pressure plate release cam 152 converts the rotating movement of the motor into the movement in the stacking direction of the sheets stacked on the pressure plate 11 to press the pressure plate 11 and press down the pressure plate 11 (see FIG. 10B). Here, since the pressure plate gear 12 is maintained at its position as it is by the load of the biasing means (not shown), a gap is provided between the pressure plate cam 121 and the first pressed portion 111. Therefore, the PWM value at this time is smaller than the PWM value at the timing C (see timing D in FIG. 12).

Figure 10C:
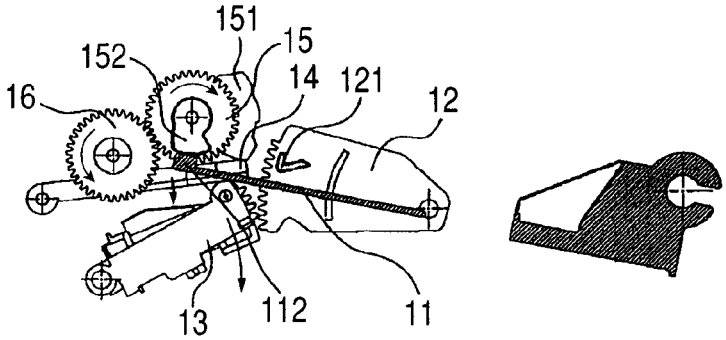

Thereafter, the release cam 151 of the first pressing-down mechanism 71 comes in contact with the stopper lever 14 and starts pressing down the stopper lever such that release cam gear 13 and the pressure plate gear 12 mesh with each other (see FIG. 10C). At this timing, the load torque applied to the motor is increased again, so that the PWM value of the motor is changed to an upward tendency (see timing A in FIG. 12).

Figure 10D:
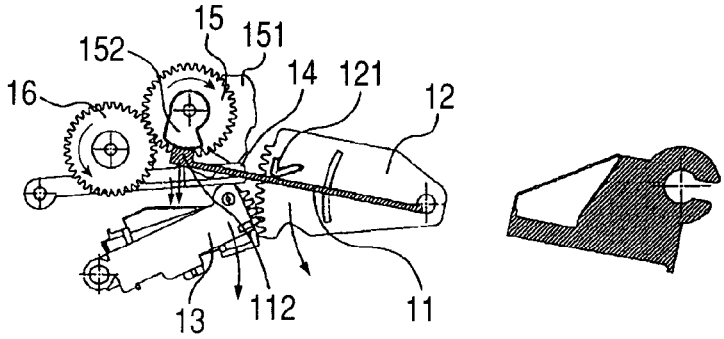

Thereafter, the pressure plate gear 12 pivots until the gap between the pressure plate cam 121 and the first pressed portion 111 disappears, and then pressing-down of the pressure plate 11 is started by the pressure plate cam 121 (see FIG. 10D).

Figure 11A:
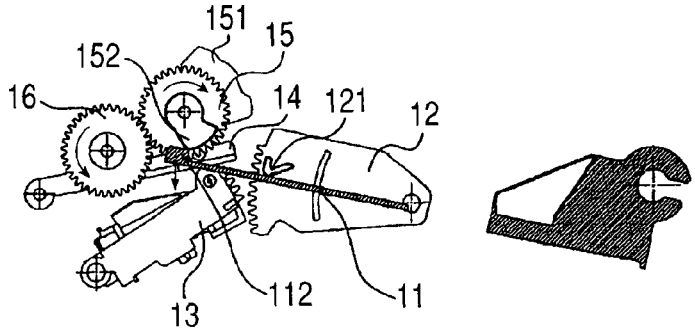
FIGS. 11A, 11B, 11C and 11D are cross-sectional views schematically illustrating an operation for transiting the sheet feeding apparatus in which few sheets are stacked from the feeding state to the non-feeding state.
Figure 11B:
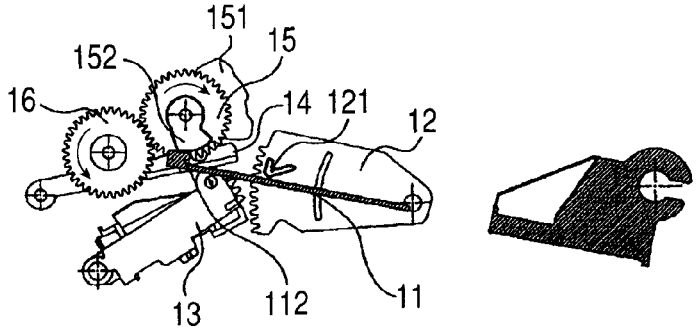
Figure 11C:
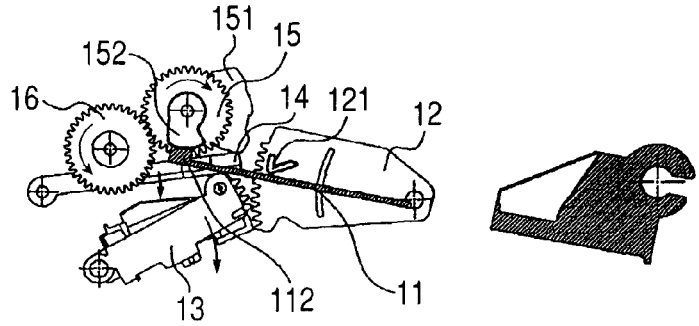
Figure 11D:
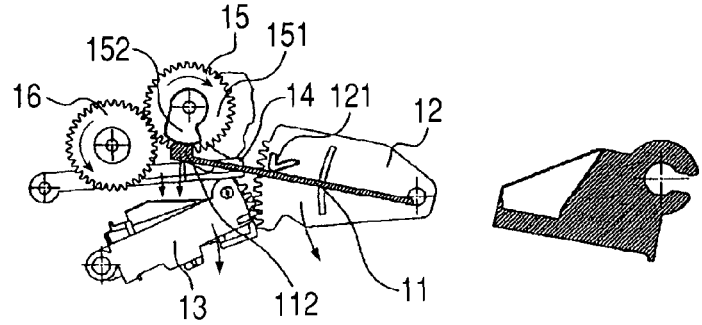

In addition, in the case where the stacking amount of the sheets is reduced, the pressure plate release cam 152 comes in contact with the second pressed portion 112 at a later timing than the case where no sheets are stacked (see FIG. 11A). Therefore, the PWM value of the motor starts increasing at a later timing than the case where no sheets are stacked (see timing E in FIG. 12). In addition, the pressure plate 11 is pressed down by the second pressing-down mechanism 72 (see FIG. 11B).

As such, the second pressing-down mechanism 72 starts pressing down the pressure plate 11 at a different timing depending on the stacking amount of the sheets. Accordingly, the PWM value of the motor starts increasing at the different timing. Moreover, the timing at which the first pressing-down mechanism 71 starts pressing down the pressure plate 11 is the same regardless of the stacking amount of sheets (timing A in FIG. 12).

The measuring means as the sheet stacking amount detecting means, as shown in FIG. 12, detects the stacking amount of the sheets stacked on the pressure plate 11 by measuring the PWM value of the motor, that is, the torque load and sensing the uprising timing.

Next, a control flow of the feeding operation will be described with reference to FIG. 13. FIG. 14 is a control block diagram of the image forming apparatus according to this embodiment.

The image forming apparatus includes a power switch 2901 which is a switch for supplying power. The image forming apparatus includes a control circuit 2902 for controlling the entire operation of the apparatus. The control circuit 2902 controls an ink jet driving mechanism 2904, a motor driving mechanism 2905, a motor driving counter 2906, and an external interface 2903.

The ink jet driving mechanism 2904 drives an ink jet nozzle part 2907 provided in the recording head 51. The motor driving mechanism 2905 supplies power to a carriage motor 2908 for driving a carriage or a sheet transporting motor 2909 for sending sheets on a platen as well as to a motor 2910 for driving the first and second pressing-down mechanisms 71 and 72.

Figure 13:
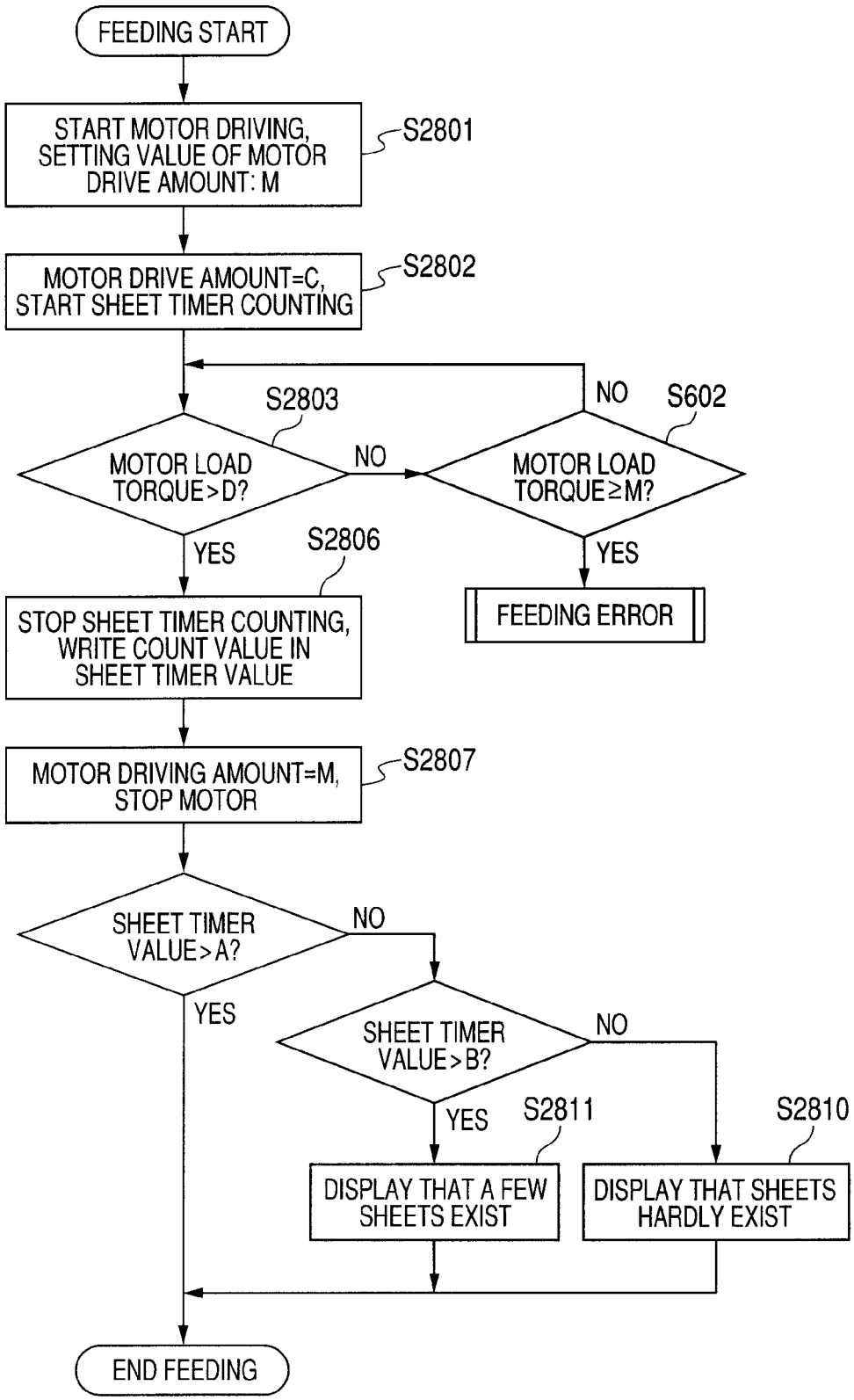
FIG. 13 is a control flow chart showing operations of the sheet feeding apparatus in the feeding state.
Figure 14:
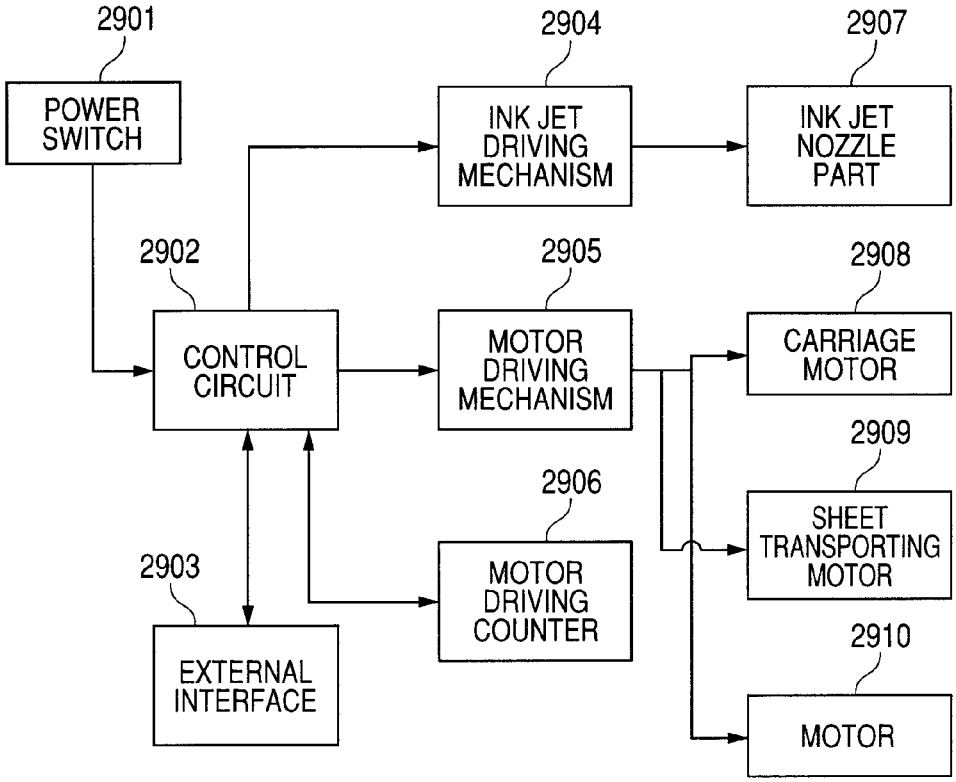
FIG. 14 is a control block diagram of the image forming apparatus illustrated in FIG. 1.
Figure 15A:
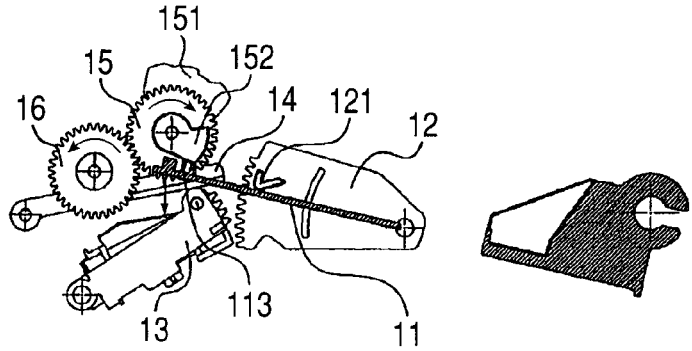
FIGS. 15A, 15B, 15C and 15D are cross-sectional views schematically illustrating an operation of transiting the sheet feeding apparatus in which no sheets are stacked from the feeding state to the non-feeding state according to the second embodiment.
Figure 15B:
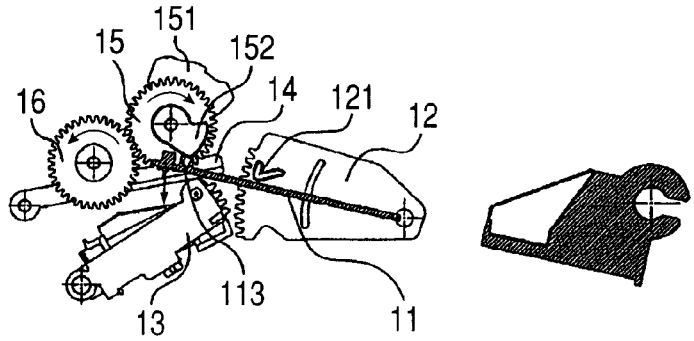
Figure 15C:
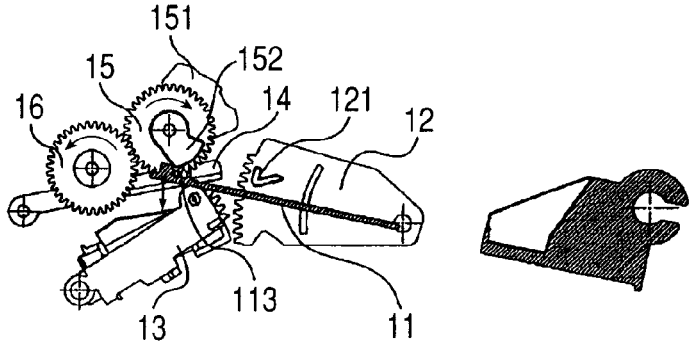
Figure 15D:
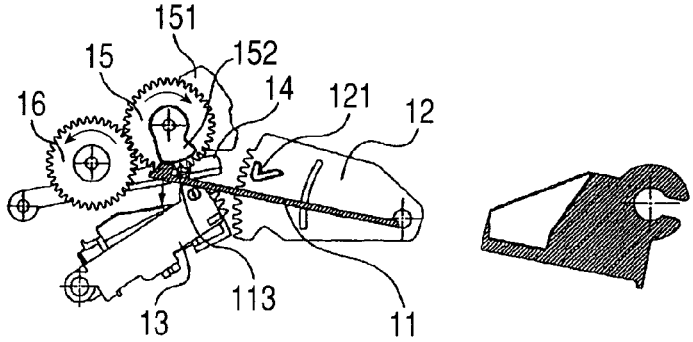
Figure 16A:
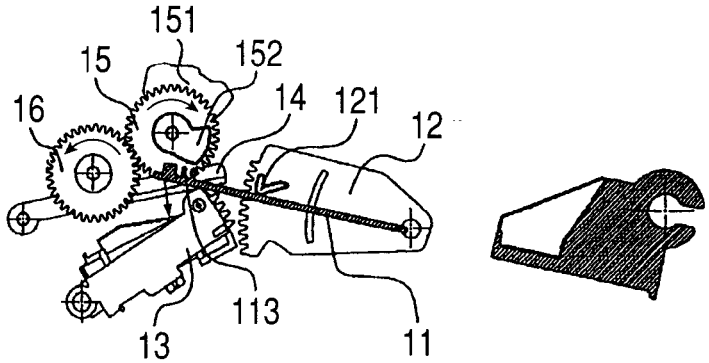
FIGS. 16A, 16B, 16C and 16D are cross-sectional views schematically illustrating an operation of transiting the sheet feeding apparatus in which hardly any sheets are stacked from the feeding state to the non-feeding state according to the second embodiment.
Figure 16B:
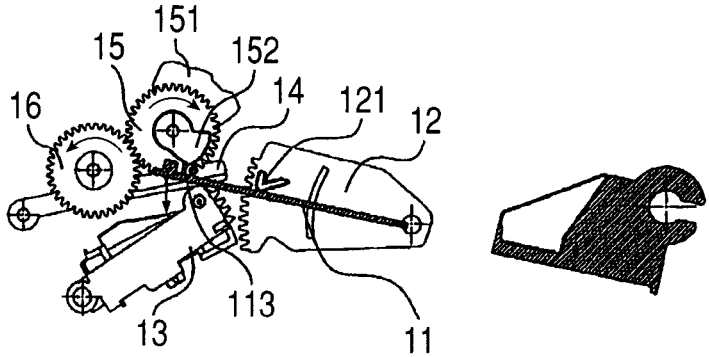
Figure 16C:
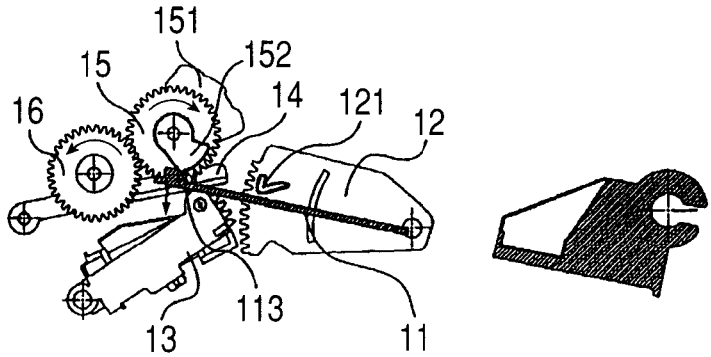
Figure 16D:
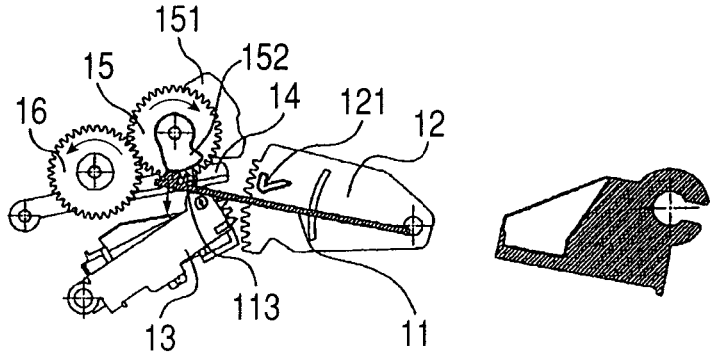
Figure 17A:
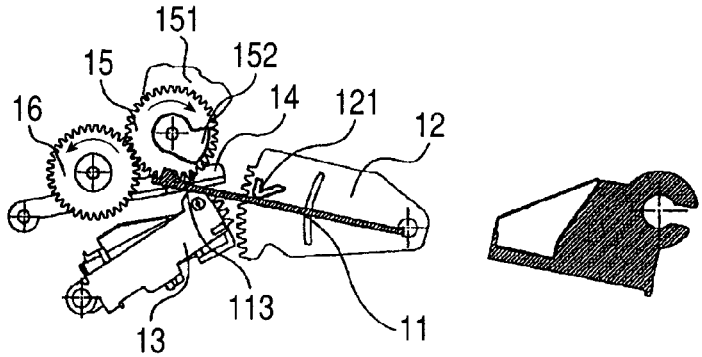
FIGS. 17A, 17B, 17C and 17D are cross-sectional views schematically illustrating an operation of transiting the sheet feeding apparatus in which few sheets are stacked from the feeding state to the non-feeding state according to the second embodiment.
Figure 17B:
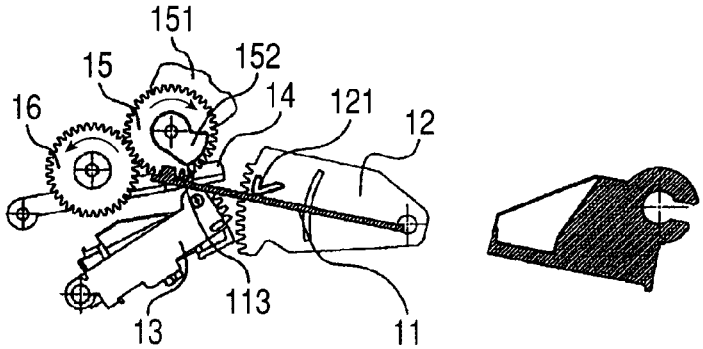
Figure 17C:
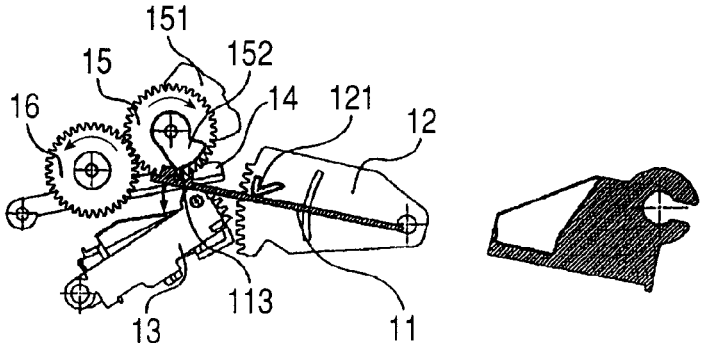
Figure 17D:
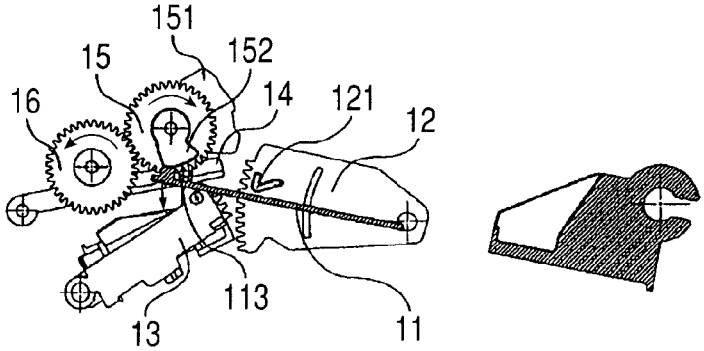

When an order for image formation is received by the image forming apparatus, the motor 2910 for driving the first and second pressing-down mechanisms 71 and 72 is driven to start the feeding operation, and the driving of the motor 2910 is started (Step S2801 in FIG. 13). The motor 2910 also functions as the drive source for driving the feeding roller 22. A setting value M of the driving amount of the motor at this time is stored in the control circuit 2902. The setting value M is a driving amount of the motor needed to rotate the control cam gear 15 once.

After starting the driving of the motor, when the motor is driven by a predetermined initial driving amount C, the motor driving measurer 2906 starts counting the driving amount of the motor (Step S2802 in FIG. 13). The initial driving amount C of the motor is set to an amount from a position where the front end of a sheet passes through a sheet separation unit including the feeding roller 22 and the separation roller 21 until the state illustrated in FIG. 9A.

Thereafter, when the sheet stacking amount detecting means senses an increase in the PWM value of the motor (Step S2803), the motor driving counter 2906 stops counting the driving amount of the motor 2910 and writes the driving amount at this time in a sheet timer value (Step S2806). Moreover, the motor 2910 stops when the driving amount reaches the initial setting value M (Step S2807).

In this embodiment, the control circuit 2902 stores first and second setting values A and B. The first setting value A set in advance is a value representing a timing at which the PWM value in FIG. 12 starts increasing when the stacking amount of sheets is reduced. The second setting value B set in advance is a value representing a timing at which the PWM value in FIG. 12 starts increasing in the case where hardly any sheets are stacked.

In addition, in the case where the sheet timer value is greater than the first setting value A, it is determined that the stacking amount of sheets is sufficient, and the process is terminated as it is for the next process. In a case where the sheet timer value is equal to or smaller than the first setting value A and greater than the second setting value B, it is determined that the stacking amount of sheets is reduced, and the content is displayed on the external interface 2903 (Step S2811 of FIG. 13). In addition, in the case where the sheet timer value is equal to or smaller than the second setting value B, it is determined that sheets are not stacked or hardly any are stacked, and the content is displayed on the external interface 2903 (Step S2810).

In addition, according to this embodiment, both of the release cam 151 as the first cam portion and the pressure plate release cam 152 as the second cam portion are formed integrally with the control cam gear 15. However, the release cam 151 may be provided separately from the control cam gear 15. In the case where the release cam 151 is provided separately from the control cam gear 15, the pressure plate release cam 152 may be driven by the same drive source as that of the release cam 151 or may also be driven by a different motor. Driving the pressure plate release cam 152 using a different motor from that of the release cam 151 means that the first and second pressing-down mechanisms 71 and 72 are driven by different motors from each other. In this case, for example, the measuring means for detecting the PWM value of the motor and measuring a time taken until the PWM value becomes equal to or greater than the setting value is provided only in the motor for driving the pressure plate release cam 152. Alternatively, the measuring means may be provided in both the motor for driving the pressure release cam 152 and the motor for driving the release cam 151.

As described above, without hardware such as a dedicated switch or sensor being added, the stacking amount of sheets can be detected by only measuring the PWM value of the motor, so that an increase in size of the apparatus is suppressed, resulting in a reduction in mechanical and electrical costs.

Next, a sheet feeding apparatus according to a second embodiment will be described. FIGS. 15A to 15D are cross-sectional views schematically illustrating an operation of transiting the sheet feeding apparatus in which no sheets are stacked from the feeding state to the non-feeding state according to the second embodiment. FIGS. 16A to 16D are cross-sectional views schematically illustrating an operation of transiting the sheet feeding apparatus in which hardly any sheets are stacked from the feeding state to the non-feeding state according to the second embodiment. FIGS. 17A to 17D are cross-sectional views schematically illustrating an operation of transiting the sheet feeding apparatus in which few sheets are stacked from the feeding state to the non-feeding state according to the second embodiment. Here, in the state illustrated in FIGS. 17A to 17D, a larger number of sheets is stacked than in the state illustrated in FIGS. 16A to 16D.

Figure 18:
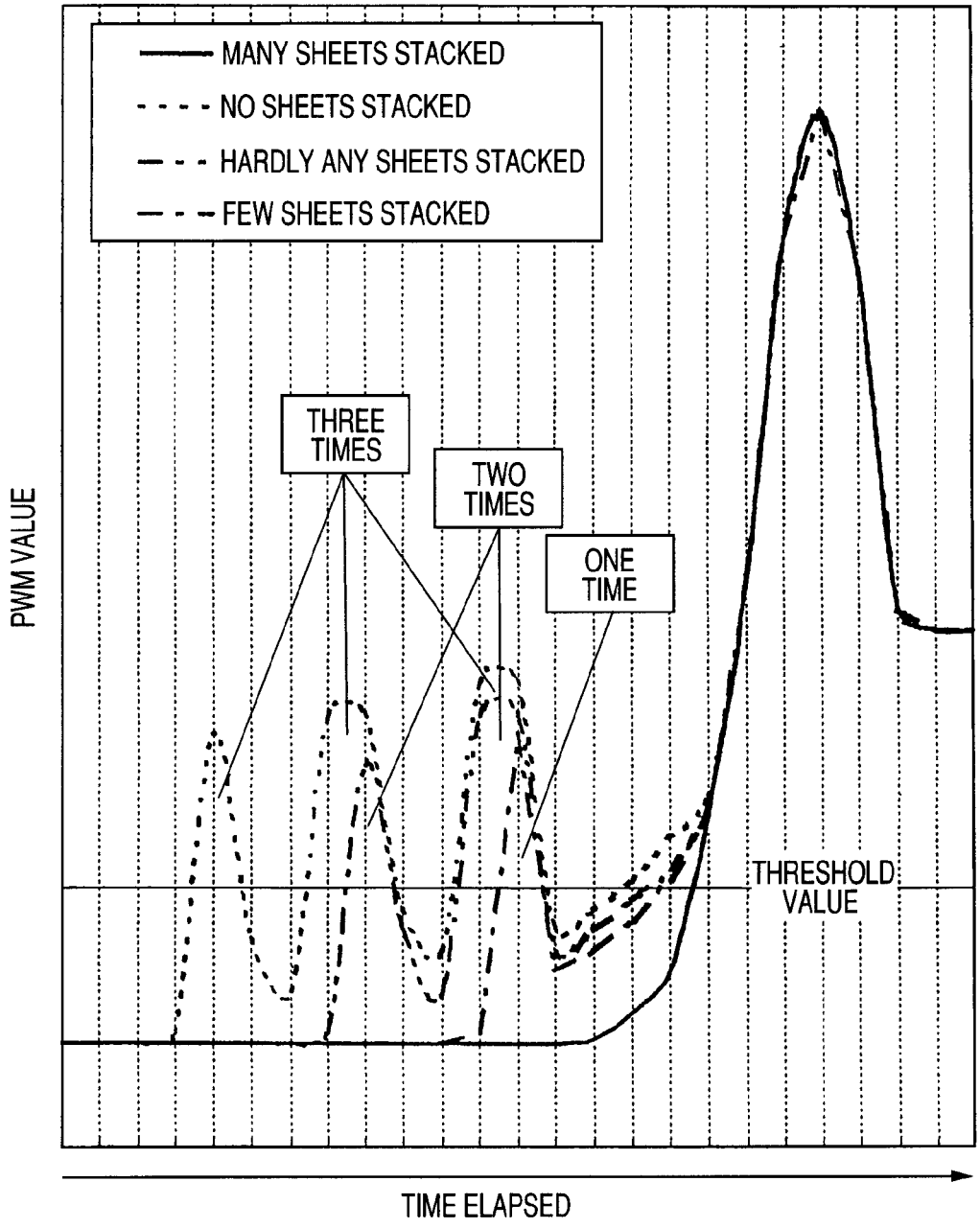
FIG. 18 is a graph showing PWM values of a motor for driving a second pressing-down mechanism when the feeding state is transited to the non-feeding state according to the second embodiment.

In addition, FIG. 18 is a graph showing PWM values of the motor depending on stacking amounts of sheets. Moreover, in FIG. 18, "hardly any sheets stacked" means the state of the sheet feeding apparatus illustrated in FIG. 16A to 16D, and "few sheets stacked" means the state of the sheet feeding apparatus illustrated in FIGS. 17A to 17D.

In the second embodiment, three protruding portions are provided in a second pressed portion 113 provided in the pressure plate 11. The pressure plate release cam 152 is adopted to come in contact or not with the protruding portions depending on the position of the pressure plate 11.

In addition, in this embodiment, the sheet stacking amount detecting means is counting means for sensing the PWM value of the motor and counting the number of times that the PWM value exceeds the threshold value set in advance from the start of driving until the first pressing-down mechanism 71 starts pressing down the pressure plate 11.

In the case where the stacking amount of sheets is large, as in the first embodiment, the second pressed portion 113 and the pressure plate release cam 152 do not come in contact with each other. Therefore, the counting means as the sheet stacking amount detecting means counts the number of times that the PWM value exceeds the threshold value as "0" (see FIG. 18).

In the case where no sheets are stacked on the pressure plate, as illustrated in FIGS. 15A to 15D, the pressure plate release cam 152 sequentially comes in contact with the three protruding portions provided in the second pressed portion 113 of the pressure plate. Therefore, as the PWM value of the motor, three peak values caused by the second pressing-down mechanism 72 pressing down the pressure plate are acquired, and the counting means as the sheet stacking amount detecting means counts the number of times that the load torque exceeds the threshold value as "3" (see FIG. 18).

In the case where hardly any sheets are stacked on the pressure plate, as illustrated in FIGS. 16A to 16D, the pressure plate release cam 152 does not come in contact with the first protruding portion and comes in contact with the second and third protruding portions. Therefore, as the PWM value of the motor, the two peak values caused by the second pressing-down mechanism 72 pressing down the pressure plate 11 are acquired, and the counting means as the sheet stacking amount detecting means counts the number of times that the load torque exceeds the threshold value as "2" (see FIG. 18).

In the case where the stacking amount of sheets stacked on the pressure plate is small, as illustrated in FIGS. 17A to 17D, the pressure plate release cam 152 does not come in contact with the first and second protruding portions and comes in contact with the third protruding portion. Therefore, as the PWM value of the motor, a single peak value caused by the second pressing-down mechanism 72 pressing down the pressure plate 11 is acquired, and the counting means as the sheet stacking amount detecting means counts the number of times that the PWM value exceeds the threshold value as "1" (see FIG. 18).

As described above, the number of times that the PWM value exceeds the threshold value is the same as the number of the protruding portions provided in the second pressed portion 113 and corresponds to the number of times that the second pressing-down mechanism 72 presses down the pressure plate 11. As such, as the number of times that the pressure plate release cam 152 comes in contact with the second pressed portion 113 of the pressure plate 11 varies depending on the stacking amount of sheets, the sheet stacking amount detecting means detects the stacking amount of sheets depending on the PWM value of the motor. In the sheet feeding apparatus according to the second embodiment, there is an advantage in that the stacking amount of sheets can be detected step by step.

According to the second embodiment, the three protruding portions are provided in the second pressed portion 113 of the pressure plate 11. However, the protruding portions may be provided on the pressure plate release cam 152 side, and even in this case, the stacking amount of sheets can be detected. In addition, according to the second embodiment, the three protruding portions are provided in the second pressed portion 113 of the pressure plate 11. However, the number of protruding positions does not need to be three and may be any number. That is, the number of times that the second pressing-down means presses down the pressure plate 11 may be arbitrarily set depending on the stacking amount of sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-277600, filed Dec. 7, 2009, which is hereby incorporated by reference herein in its entirety.

What is claimed is:

1. A sheet feeding apparatus comprising:

sheet feeding means which comes in pressure contact with a sheet to feed the sheet;

a pressure plate on which sheets are stacked and which is biased so that an uppermost sheet of the stacked sheets comes in pressure contact with the sheet feeding means;

a first pressing-down mechanism which presses down the pressure plate to separate the uppermost sheet and the sheet feeding means by a constant distance when the sheet feeding means is not operated;

a second pressing-down mechanism which is adopted to press down the pressure plate when an amount of the sheets stacked on the pressure plate is smaller than a predetermined amount; and control means which measures a load applied to the second pressing-down mechanism and determines a stacking amount of the sheets stacked on the pressure plate on the basis of the measured load.

2. The sheet feeding apparatus according to claim 1, wherein before the second pressing-down mechanism presses down the pressure plate, the position of the pressure plate is changed according to the stacking amount of the sheets, wherein the second pressing-down mechanism has a rotary cam to press down the pressure plate, and the rotary cam is adopted to change a timing to start pressing down the pressure plate depending on the position of the pressure plate, and the control means detects the stacking amount of the sheets stacked on the pressure plate by measuring a timing at which the load given from the pressure plate increases.

3. The sheet feeding apparatus according to claim 1, wherein before the second pressing-down mechanism presses down the pressure plate, the position of the pressure plate is changed according to the stacking amount of the sheets, wherein the second pressing-down mechanism has a rotary cam to press down the pressure plate, the pressure plate has protruding portions to be contacted by the rotary cam, and the protruding portions are adopted to change the number of times that the rotary cam presses down the pressure plate depending on the position of the pressure plate, and the control means detects the stacking amount of the sheets stacked on the pressure plate by measuring the number of times that the load given from the pressure plate exceeds a threshold value set in advance.

4. The sheet feeding apparatus according to claim 1, wherein the second pressing-down mechanism is adopted to press down the pressure plate only when the amount of the sheets stacked on the pressure plate is smaller than an amount set in advance.

5. The sheet feeding apparatus according to claim 1, further comprising a motor for driving the second pressing-down mechanism, wherein the control means detects the stacking amount of the sheets stacked on the pressure plate on the basis of a load torque of the motor.

6. The sheet feeding apparatus according to claim 5, wherein the motor drives both the first and second pressing-down mechanisms, and the second pressing-down mechanism presses down the pressure plate from a time point at which the sheet feeding means feeds the uppermost sheet until the first pressing-down mechanism presses down the pressure plate.

7. The sheet feeding apparatus according to claim 6, wherein the first pressing-down mechanism has a first cam portion for converting a rotating movement of the motor into a movement in a stacking direction of the sheets stacked on the pressure plate, and a transmission member for transmitting the movement of the first cam portion to the pressure plate to move the pressure plate by a constant distance, and the second pressing-down mechanism has a second cam portion which is formed integrally with the first cam portion and converts the rotating movement of the motor into the movement in the stacking direction to press a pressed portion of the pressure plate and press down the pressure plate.

8. An image forming apparatus which includes the sheet feeding apparatus according to claim 1 and an image forming unit which forms an image on a sheet fed by the sheet feeding apparatus.

9. A sheet feeding apparatus comprising:

sheet feeding means for feeding a sheet;

a pressure plate on which sheets are stacked and which is biased so that an uppermost sheet of the stacked sheets comes in pressure contact with the sheet feeding means;

pressing-down means which presses down the pressure plate to separate the uppermost sheet and the sheet feeding means when the sheet feeding means is not operated; and control means for measuring a load applied to the pressing-down means when the pressing-down means presses down the pressure plate and sending information on a stacking amount of the sheets depending on the measured load.

10. The sheet feeding apparatus according to claim 9, wherein the control means sends the information on the stacking amount of the sheets on the basis of a timing of a change in the load applied to the pressing-down means.

11. The sheet feeding apparatus according to claim 9, wherein the pressing-down means includes first and second cam portions for pressing down the pressure plate, the second cam portion is operated only when the pressure plate is higher than a predetermined height, and the control means sends the information on the stacking amount of the sheets by sensing the load applied to the pressing-down means when the second cam portion is operated.

12. The sheet feeding apparatus according to claim 11, wherein the control means sends information signifying that the stacking amount of the sheets is smaller in a case where there is a change in the load applied to the pressing-down means when the second cam portion is operated than that in a case where there is no change.

13. The sheet feeding apparatus according to claim 11, wherein the pressing-down means has:

a pressure plate gear which is pivotable in connection with the pressure plate; and a gear which is pivoted by the second cam portion and starts meshing with the pressure plate gear while pivoting with the pressure plate gear to cause the pressure plate gear to pivot by a substantially predetermined amount from the start of the meshing until the pivoting by the second cam portion is terminated.

14. An image forming apparatus which includes the sheet feeding apparatus according to claim 9 and an image forming unit which forms an image on a sheet fed by the sheet feeding apparatus.

15. A sheet feeding apparatus comprising:

a feeding unit configured to feed a sheet;

a pressure plate on which sheets are stacked and which is biased so that an uppermost sheet of the stacked sheets comes into contact with the feeding unit;

a pressing unit configured to press down the pressure plate to separate the uppermost sheet from the sheet feeding unit; and a determining unit configured to determine a stacking amount of the sheets stacked on the pressure plate on the basis of a load of the pressing unit.

16. The sheet feeding apparatus according to claim 15, wherein the determining unit determines the stacking amount on the basis of a change of the load.

17. The sheet feeding apparatus according to claim 16, the pressing unit comprises a first cam and a second cam that rotate simultaneously and each press down on the pressure plate, wherein, when rotating, the second cam starts pressing down the pressure plate earlier than the first cam, wherein the determining unit determines the stacking amount on the basis of the change of the load caused by the first cam and the second cam.

18. The sheet feeding apparatus according to claim 17, wherein the first cam does not press the pressure plate down when the pressure plate is higher than a predetermined height, and the second cam does not press the pressure plate down when the pressure plate is lower than the predetermined height.

19. The sheet feeding apparatus according to claim 17, wherein the determining unit determines the stacking amount on the basis of a timing that the load increases to exceed a threshold while the pressing unit presses down the pressure plate.

20. The sheet feeding apparatus according to claim 19, wherein the determining unit determines that the stacking amount is larger than a predetermined amount when the load exceeds the threshold after a predetermined time period.

21. The sheet feeding apparatus according to claim 19, wherein the determining unit determines that stacking amount is nearly nothing when the load exceeds the threshold earlier than a predetermined time period.

22. The sheet feeding apparatus according to claim 15, wherein the pressing unit comprises a motor controlled by pulse width modulation, and the load is determined by a pulse width of a current when the motor is driven.

23. An image forming apparatus comprising the sheet feeding apparatus according to claim 15, and an image forming unit which forms an image on a sheet fed by the sheet feeding apparatus.

* * * * *